United States Patent [19]

Stanley et al.

[11] 4,043,009

[45] Aug. 23, 1977

[54] STRAND TREATMENT

[75] Inventors: Robert K. Stanley, Media; Ira Schwartz, Philadelphia, both of Pa.

[73] Assignee: Textured Yarn Co., Inc., Kennett Square, Pa.

[21] Appl. No.: 341,320

[22] Filed: Mar. 14, 1973

Related U.S. Application Data

[63] Continuation-in-part of Ser. No. 222,135, Jan. 31, 1972, Pat. No. 3,722,042.

[51] Int. Cl.[2] ..... D02G 1/12

[52] U.S. Cl. ..... 28/221; 28/265; 28/270

[58] Field of Search ..... 28/1.6, 72.14

[56] References Cited

U.S. PATENT DOCUMENTS

| | | | |
|---|---|---|---|
| 3,099,064 | 7/1963 | Haynes | 28/1.6 |
| 3,298,079 | 1/1967 | Agett et al. | 28/1.6 X |
| 3,500,518 | 3/1970 | Stanley et al. | 28/1.6 |
| 3,636,599 | 1/1972 | Stanley | 28/1.6 |
| 3,707,299 | 12/1972 | Trifunovic | 28/1.6 |
| 3,722,042 | 3/1973 | Stanley et al. | 28/1.6 |
| 3,835,513 | 9/1974 | Stanley | 28/72.14 |

FOREIGN PATENT DOCUMENTS

| | | | |
|---|---|---|---|
| 58,158 | 5/1967 | Germany | 28/72.14 |

*Primary Examiner*—Louis K. Rimrodt
*Attorney, Agent, or Firm*—Miller & Prestia

[57] ABSTRACT

While being fed into a laterally confining region to be retained temporarily and be compressively crimped therein, laterally spaced textile strands are traversed laterally to and fro along the entrance to the region. The resulting uneven cross-sectional distribution of crimped strand accumulation in the region is conductive to separation of individual strands upon exiting from the region.

13 Claims, 4 Drawing Figures

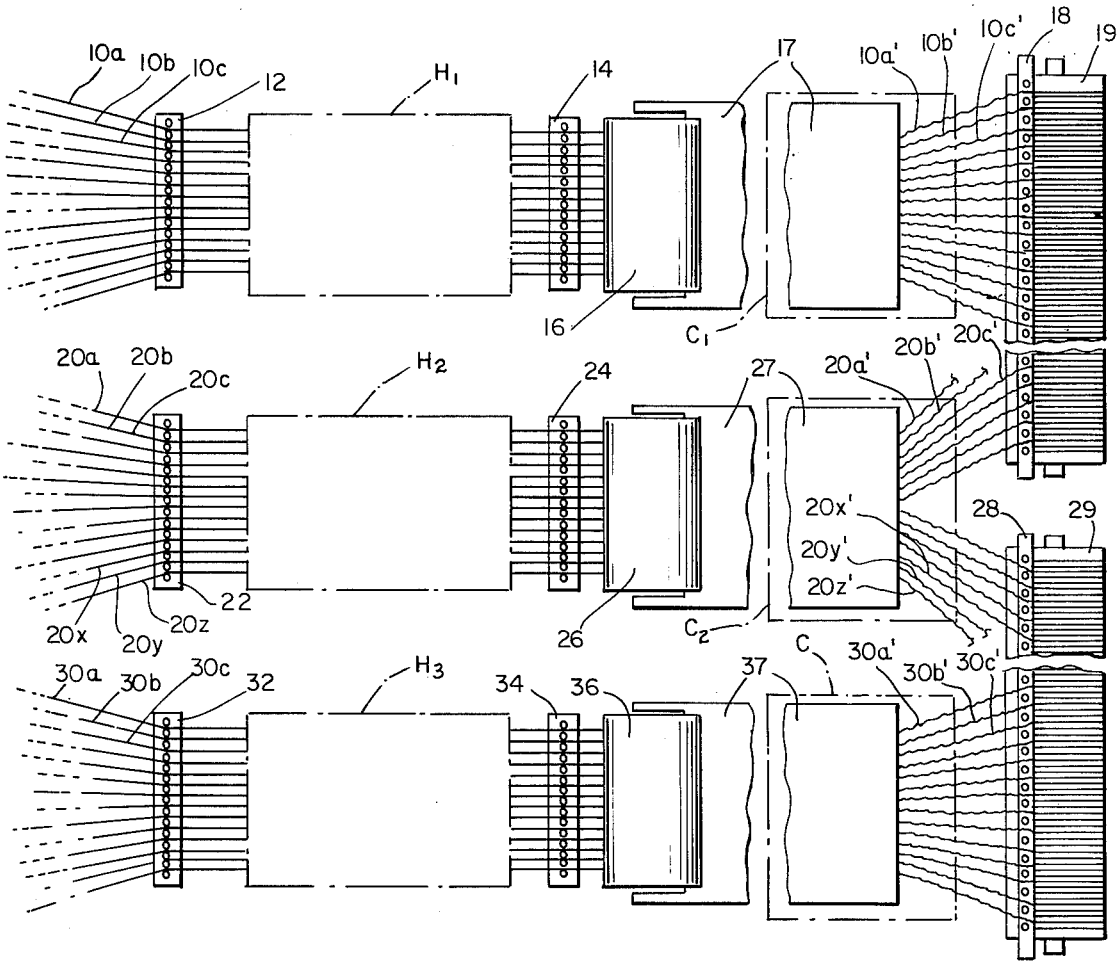
Fig. 1
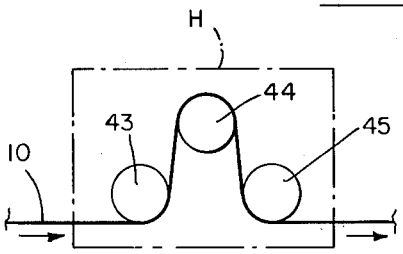
Fig. 2
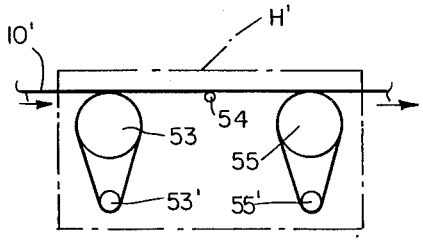
Fig. 3
Fig. 4
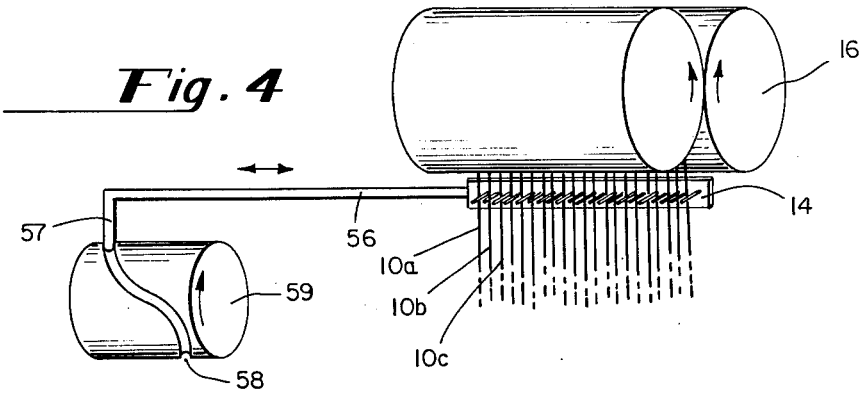

STRAND TREATMENT

This is a continuation-in-part of my similarly entitled copending patent application, Ser. No. 222,135 filed Jan. 31, 1972, now Pat. No. 3,722,042, granted 3/27/73.

This invention relates to compressive crimping of textile strands, as in a stuffing chamber.

Textile strands subjected to longitudinally compressive crimping are customarily treated either one strand (which may be either monofilament or multifilament) at a time, or a multiplicity of such strands simultaneously, in a single temporarily confining region. Despite apparent throughout advantages of multiple strand treatment, the crimped strands cannot be separated readily from one another upon (or after) being withdrawn from the crimped strand accumulation within the confining region.

A primary object of the present invention is simultaneous compressive crimping of a plurality of textile strands in a single laterally confining region without impairing separability of the individual strands.

Another object is improvement in the feeding of a plurality of laterally spaced textile strands into a compressive crimping region.

A further object is provision of traversing guide means conducive to the foregoing objects.

Other objects of this invention, together with means and methods for accomplishing the various objects, will be apparent from the following description and the accompanying diagrams, which are exemplary rather than limitative.

FIG. 1 is a schematic plan representation of elements for practicing the present invention;

FIG. 2 is a schematic side elevation of apparatus useful in a certain component of FIG. 1;

FIG. 3 is a schematic side elevation of other apparatus useful in a component of FIG. 1; and FIG. 4 is a perspective view (on an enlarged scale) of other apparatus components of FIG. 1, together with an embodiment of traverse drive means, also rather schematic.

In general, the objects of the present invention are accomplished, in compressive crimping of textile strands in a laterally confining region having an entrance and an exit, by feeding a multiplicity of strands spaced laterally from one another into the entrance and simultaneously traversing the strands to and fro along the entrance, and subsequently winding the crimped strands side-by-side onto a beam or the like.

FIG. 1 shows, schematically, a multiplicity of individual strands 10*a,* 10*b,* 10*c,* etc. being forwarded from one or more sources (not shown) to pass through pin guide 12, which spaces them laterally, and then through heating enclosure $H_1$. Thereupon the strands pass over infeed traverse guide means 14, which also carries individual strand guides. Next the strands pass between pair of nip rolls 16 (only the upper one being visible) into laterally confining chamber 17, part of the length of which is contained in cooling enclosure $C_1$, and the rest of which is omitted from the view to conserve space of illustration. Crimped strands 10*a'*, 10*b'*, 10*c'*, etc. so designated to distinguish them from the corresponding starting strands designated by unprimed reference numerals) are wound up from the exit of the chamber over beam traverse guide 18 and onto beam 19.

In like manner, strands 20*a,* 20*b,* 20*c,* etc. pass over pin guide 22, through heating enclosure $H_2$, over infeed traverse guide 24, between feed rolls 26, and through laterally confining chamber 27 and cooling enclosure $C_2$. From the exit of the chamber, crimped strands 20*a'*, 20*b'*, 20*c'*, etc. pass over traverse guide 18 and onto beam 19, while strands 20*x'*, 20*y'*, 20*z'*, etc. pass over traverse guide 28 and wind onto beam 29, similar to and aligned with the first beam. Also wound onto the latter beam after passing over its traverse guide 28 are crimped strands 30*a'*, 30*b'*, 30*c'*, etc. resulting from treatment of strands 30*a,* 30*b,* and 30*c* in like manner on like apparatus designated similarly by reference numerals in the 30's.

Drive means for the various beams and rolls are omitted from this and succeeding views as superfluous because merely conventional. The illustration is also simplified by showing only relatively few strands for each crimper, instead of the many tens or a hundred or more that may be so treated quite successfully. More detailed disclosure of such crimping apparatus is contained in my aforementioned parent application.

FIG. 2 shows, in end elevation, enclosure H, which may comprise any one or more (usually all) of heating enclosures $H_1$, $H_2$, and $H_3$ of the preceding view. Such chamber contains a three-roll arrangement of rolls 43 and 45 in the undiverted path of web 10 of the individual strands (not shown separately in this view) and intervening roll 44 located at a different level and about which the web of strands travels, thereby diverting the strand path. All three rolls are preferably driven alike (i.e., at uniform surface speed) in step with the speed of crimper feed rolls 16, whereupon tension variations are counteracted. Thus, when the web tension decreases between rolls 43 and 44, slippage occurs to some extent about all three rolls, thereby tending to reduce the web speed and tending to restore the tension applied by the crimper feed rolls; alternatively, when the web tension in the heating enclosure increases, the tightening of the web against the rolls brings its speed up closer to roll speed, thereby tending toward uniform feed roll tension.

FIG. 3 shows, in like view, alternative heating enclosure H', which may be the same physical enclosure as H but which contains different apparatus. In this arrangement two roll pairs act to draw the strands to increased length. When the strand is to be so drawn in the enclosure, it is wrapped about snubbing pin 54, and godet roll 55 is overdrawn relative to godet roll 53, e.g., at a surface speed ratio of about four times (for a 4X draw). Separator rolls 53' and 55' are associated with the corresponding godets, and the strands make at least one wrap about each roll pair.

It should be understood that both tension-equalization apparatus, of which an example appears in FIG. 2, and strand-drawing apparatus, exemplified in FIG. 3, may be contained--preferably arranged in the stated order--in the same heating enclosure, from which the strands proceed to the stuffing chamber closely adjacent thereto. Although not so shown in the schematized illustration here, such chamber preferably takes the shape of a simple hollow parallepipedal cylinder having a rectangular bore. The nip rolls, which feed or "stuff" the strands into the entrance to the bore, are overlapped at their ends (as shown stylized in FIG. 1) by the front and rear walls of the chamber as far as the roll nip so as to ensure that no strand escapes entering the chamber.

It will be understood that, as the strands accumulate in the chamber, the entering strands meet with resistance provided by the previously accumulated strands and buckle back and forth into a modified sawtooth or zigzag configuration or crimp. As more of each strand is fed continuously into the chamber, the strand accumulation is forced thereby along through the bore toward the exit therefrom, which is preferably unobstructed, together with the rest of the chamber bore, as disclosed in U.S. Pat Nos. 3,279,025 and 3,386,142. Crimped strands, designated by primed reference numerals, are withdrawn, at a constant or fixed preadjustable rate, from the strand accumulation inside their respective stuffing chambers and are beamed as already described.

FIG. 4 shows, in more detail and similarly schematically, guide means 14, over which the strands pass before entering the nip of feed rolls 16. This guide means is a device for traversing the strands back and forth along the roll nip, as is described to assure preferred distribution thereof transversely of chamber 17 (not shown here) in which the strands accumulate in crimped configuration. Similar traverse guide means are juxtaposed to the nips of pairs of rolls 26 and 36 at the entrance to respective stuffing chambers 27 and 37. Only the first will be described here.

The traverse guide means carries laterally spaced pins or like traverse guides (unnumbered) in line with the respective paths of strands 10*a,* 10*b,* and 10*c* to the nip of feed rolls 16. The respective guides are spaced closely together on the guide means but not so closely as to impede passage of the strands thereby. The guide means is affixed to one end of cam rod 56 suitably journaled to reciprocate back and forth parallel to the roll nip. Cam rod 56 terminates in follower end 57 engaged in traverse groove 58 of cam roll 59. It will be apparent that as the cam roll rotates it traverses the guide means and the guides thereon back and forth and thereby traverses the strands to and fro along the feed roll nip, which (as indicated in preceding views) defines the entrance to the confining region otherwise bounded by chamber 17.

Not shown, although preferably present, are means just inside the stuffing chamber entrance for deflecting the entering strands laterally toward the chamber axis, as set forth in U.S. Pat. No. 3,553,802. Of course, when the system is operating, the strands are laid into the chamber entrance, via a close approximation of simple harmonic motion by reason of the traverse action.

The embodiment of this invention just described produces in the confining chamber a multiplicity of side-by-side columns of crimped strand accumulation, each of which is less compact along its axis than at its edges--which correspond to traverse reversals--whereupon each column tends to consolidate laterally toward its axis. The strand density perpendicular to the traverse direction (and to the axis) is relatively uniform at an intermediate value. While some tendency remains for the crimped strands to intermingle along their adjacent edges, they retain their individual identity upon individual withdrawal from the chamber. Such result is a great improvement over conventional multiple strand crimping, in which the individual strands tend to become so entangled in the stuffing chamber as to snag or break upon withdrawal therefrom. Where beaming of a multiplicity of strands is concerned, the resulting minimization of snagging and breaking provides a considerable productivity increase.

Although specific embodiments of the invention have been illustrated and described, other modifications may be made if desired. Thus, parts or steps may be added, combined, or subdivided, or equivalents be substituted therefor, while retaining at least some of the advantages and benefits of the invention, which is defined in the following claims.

The Claimed Invention:

1. In compressive crimping of textile strands in a laterally confining region having an entrance and an exit, the improvement comprising feeding a multiplicity of strands spaced laterally from one another into the entrance of said region and simultaneously traversing the strands to and fro along said entrance while maintaining spacing between the strands, removing the crimped strands through the exit of the confining region, and winding them side-by-side onto a beam.

2. Strand-crimping according to claim 1, including so feeding and traversing strands into a plurality of such confining regions simultaneously, removing them therefrom, and winding them side-by-side onto a beam.

3. Multiple-end stuffer crimping of textile strands comprising feeding a multiplicity of strands spaced laterally from one another, dividing the strands into a plurality of groups each comprising a plurality of adjacent strands, feeding the respective groups of strands into a like plurality of laterally confining stuffing chambers, each such chamber having also an exit for removal of crimped strands therefrom, traversing the strands to and fro along each entrance while maintaining spacing between the strands, removing crimped strands through each exit, and winding them side-by-side onto a beam.

4. Strand-crimping according to claim 3, wherein strands from a plurality of such confining regions are wound onto a single beam.

5. Strand-crimping according to claim 3, wherein some of the strands from a single such confining region are wound onto a first beam and other of such strands from such region are wound onto a second beam.

6. Strand-crimping according to claim 5, wherein some of the strands from a plurality of the regions are wound onto a first beam and other of the strands therefrom are wound onto a second beam.

7. In apparatus for compressive crimping of textile strands, the improvement, in conjunction with a laterally confining crimping chamber, of a multiple strand guide juxtaposed to the chamber entrance, the guide being movable laterally to traverse a multiplicity of strands laterally spaced from one another to and fro along the entrance, and beaming means for receiving the strands from the chamber exit and winding the strands thereonto.

8. Strand-crimping apparatus according to claim 7, wherein the guide-traversing means comprises a grooved camming roll, and the guide has a follower positioned for camming contact therewith.

9. Strand-crimping apparatus comprising a plurality of laterally confining stuffing chambers, each having an entrance and an exit, means for feeding strands into the respective entrances, means for withdrawing strands through the respective exits, and multiple strand-traversing means juxtaposed to the feeding means and having multiple spaced positions for guiding spaced strands and for traversing a multiplicity of laterally spaced strands to and fro along the entrances.

10. Strand-crimping apparatus according to claim 9, including strand-drawing means immediately preceding the strand-traversing means.

11. Strand-crimping apparatus according to claim 9, including means for equalizing strand tension at substantially constant length immediately preceding the strand-traversing means.

12. Strand-crimping apparatus according to claim 11, including strand-heating means preceding the strand-traversing means.

13. Strand-crimping apparatus according to claim 9, including strand-cooling means between the entrance and the exit of the stuffing chambers.

* * * * *